United States Patent [19]

Klomp

[11] 4,280,456

[45] Jul. 28, 1981

[54] ENGINE WITH INTAKE PORTED CYLINDERS AND POROUS PORT LINERS FOR OIL CONTROL

[75] Inventor: Edward D. Klomp, Mt. Clemens, Mich.

[73] Assignee: General Motors Corporation, Detroit, Mich.

[21] Appl. No.: 88,299

[22] Filed: Oct. 26, 1979

[51] Int. Cl.[3] ..... F01M 11/08

[52] U.S. Cl. ..... 123/196 R; 123/193 C; 184/6.5

[58] Field of Search ..... 123/65 R, 65 P, 193 C, 123/196 R, 196 M; 184/6.5, 6.8; 92/169, 170, 171

[56] References Cited

U.S. PATENT DOCUMENTS

| | | | |
|---|---|---|---|
| 1,807,721 | 6/1931 | Young | 123/196 R |
| 2,818,359 | 12/1957 | LaBelle et al. | 148/2 |
| 3,000,370 | 9/1961 | Kunzog | 123/193 C |
| 3,286,792 | 11/1966 | Wall | 123/196 R X |
| 3,995,609 | 12/1976 | Klomp | 123/188 S |
| 4,093,842 | 6/1978 | Scott | 219/121 LM |

*Primary Examiner*—Tony M. Argenbright
*Attorney, Agent, or Firm*—Robert J. Outland

[57] ABSTRACT

An engine having piston-controlled cylinder air intake ports into which lubricating oil may be carried during engine operation is fitted with porous liners in the cylinder intake ports which receive the lubricating oil to prevent its being carried by the inlet air into the engine combustion chamber and exhaust system. Collection and return passages are provided to receive oil drained from the porous liners and return it to the engine crankcase and oil sump. A slight flow of pressurized air from the engine air chamber aids the draining and return passage of oil from the porous liners to the crankcase.

1 Claim, 4 Drawing Figures

ENGINE WITH INTAKE PORTED CYLINDERS AND POROUS PORT LINERS FOR OIL CONTROL

TECHNICAL FIELD

This invention relates to engines having cylinder intake ports, for example, of the two-stroke cycle type, and more particularly to lubricating oil control means for such engines.

BACKGROUND OF THE INVENTION

It is known in the engine art to provide cylinders with air intake ports through which charging and scavenging air is supplied to the engine combustion chambers, the ports being controlled by the reciprocating movement of the pistons and their associated piston rings within the cylinders during operation of the engine. It is also common to supply lubricating oil to the lower walls of the cylinders for lubrication of the sliding motion of the piston skirt and rings on the cylinder walls. During the reciprocating motion, in spite of the provision of oil control rings near the lower edge of the piston skirt, some small amount of lubricating oil will be continually displaced from the cylinder wall and piston surfaces into the cylinder intake ports. This oil may subsequently be picked up by the incoming charging and scavenging air and carried into the engine combustion chamber. Here some is burned in the normal combustion process and its residual products discharged to the engine exhaust system, while the remainder passes directly to the engine exhaust during scavenging of the cylinder with the fresh air charge.

In all engine arrangements, the result is an undesired loss of lubricants oil and a possible increase in engine combustion chamber deposits and/or exhaust emissions. If the engine is fitted with an emission control device, such as a catalytic converter, the additives found in engine lubricating oil may have a deleterious effect on the converter catalyst itself. Thus it is desired to improve control of the passage of lubricating oil into the engine combustion chambers and exhaust system to the extent possible, consistent with the necessity to provide lubrication for the reciprocating components.

SUMMARY OF THE INVENTION

The present invention provides oil control devices in the form of porous inserts or liners fitted in the intake ports of the engine cylinders in a manner to absorb into their pores the droplets of lubricating oil which may be delivered from the cylinder walls into the cylinder ports. This action takes the lubricating oil out of the airstream and effectively prevents its delivery with the charging air into the engine combustion chambers.

The cylinder walls are further provided with collector and drain means for collecting oil from the porous inserts and returning it through the walls of the cylinders to the engine crankcase. This action may be aided by flow of a small volume of pressurized air from the engine air chamber through the porous inserts and the collector means into the crankcase so as to keep the pores of the inserts and the passages open.

The result is a reduction in the amount of lubricating oil passed into the engine combustion chambers and exhaust system without requiring any comparable reduction in the amount of oil provided for lubricating the piston and cylinder walls. These and other features and advantages of the invention will be more fully understood from the following description of a preferred embodiment taken together with the accompanying drawing.

BEST MODE FOR CARRYING OUT THE INVENTION

Figure 1:
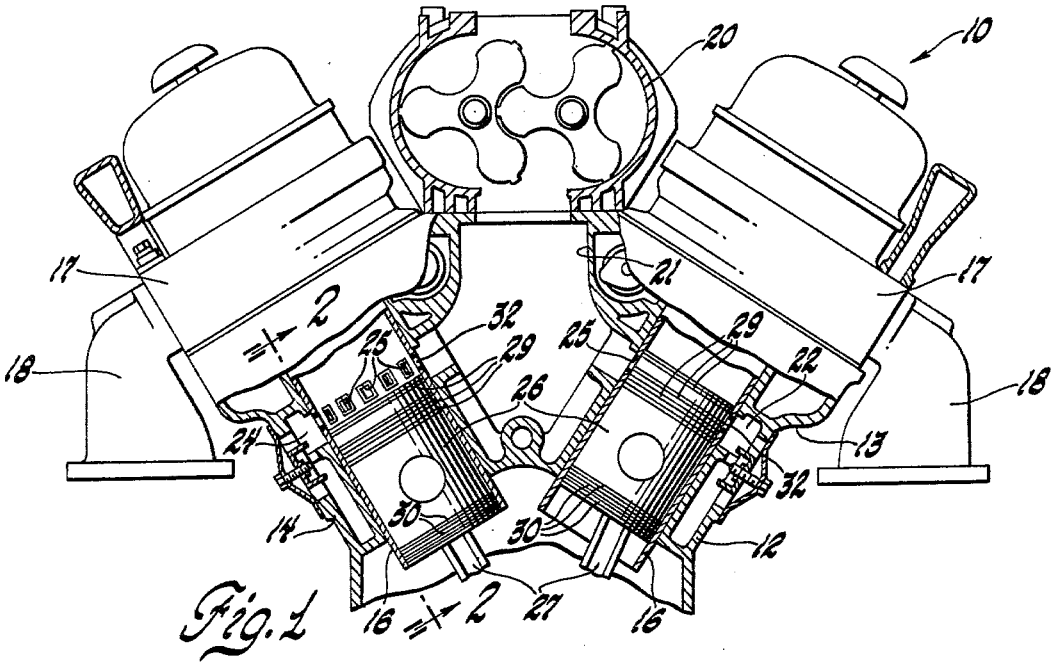
FIG. 1 is a partial end view of a ported cylinder two-stroke cycle diesel engine according to the invention, with portions broken away to show pertinent features of interior engine construction.

Referring now to the drawing in detail, numeral 10 generally indicates a two-stroke cycle diesel engine of a type in common commercial use, but modified to include means in accordance with the present invention. Engine 10 includes the usual cylinder block 12 defining a pair of cylinder banks 13, 14, each including a plurality of cylinder-defining liners 16.

The upper ends of the cylinder liners are closed by cylinder heads 17 which include the usual exhaust valves and fuel injectors, not shown, and provide passages for exhaust gases to be carried into the exhaust manifolds 18 secured to the sides of the cylinder heads.

On the top of the cylinder block between the cylinder heads, there is mounted an engine-driven air blower 20 that supplies pressurized air to an air chamber 21 formed within the cylinder block between the cylinder banks and extending outwardly around the cylinder liners in zones 22, 24, intermediate the cylinder ends. Within these zones, the cylinder liners are provided with a plurality of intake ports 25 through which pressurized air from the air chamber is delivered to the interior of the cylinder liners.

In each of the liners there is disposed a piston 26 connected by a connecting rod 27 to the engine crankshaft, not shown. The pistons are fitted with compression rings 29 near their upper ends and oil control rings 30 near their lower ends. These rings, together with the pistons engage the walls of the cylinder liners in normal operation. Lubricating oil is provided by conventional means, not shown, to lubricate the cylinder walls against excessive wear from movement of the reciprocating parts.

The reciprocating motion of the pistons is utilized to control the flow of scavenging and charging air from the engine air chamber into the engine cylinders. Downward motion of the pistons to their bottom dead-center positions uncovers the intake ports of their respective cylinders. This allows the desired flow of air into their combustion chambers to scavenge out the spent exhaust gases through the concurrently opened engine exhaust valves and provides fresh charges of air for subsequent combustion in the respective combustion chambers. Subsequent upward movement of the pistons moves the compression rings 29 above the intake ports, closing the ports against further passage of air therethrough.

However, this piston reciprocating motion also has the effect of carrying upwardly on the cylinder walls small amounts of the lubricating oil, some of which comes off the piston and cylinder surfaces and is deposited within the cylinder liner intake ports.

Figure 2:
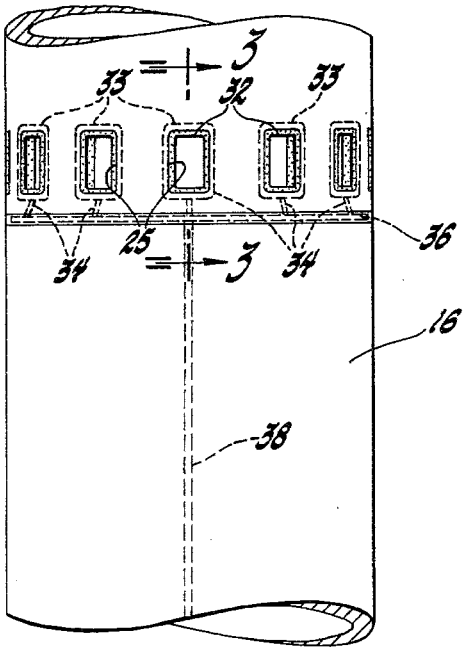
FIG. 2 is a fragmentary side view of one of the engine cylinder liners as seen from the plane indicated by the line 2—2 of FIG. 1.
Figure 3:
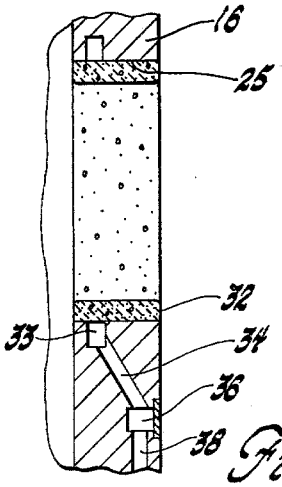
FIG. 3 is an enlarged cross-sectional view of the cylinder inlet port area as seen from the plane indicated by the line 3—3 of FIG. 2.

As is best shown in FIGS. 2 and 3, the cylinders for the engine of the present invention are provided with intake port oil control means which have the purpose of preventing or limiting the pick-up of oil in the cylinder intake ports by the charging air and the resulting loss of that lubricating oil through delivery to the engine combustion chambers and exhaust system. These oil control means include porous port inserts or liners 32 extending peripherally within the cylinder liner intake ports for the purpose of receiving in their pores lubricating oil delivered to the interior of the ports. The port liners 32 may be made of any suitable porous material, such as, compacted wire mesh, sintered metal, porous ceramic, or the like, which may be capable of withstanding the operating conditions within the engine cylinders.

Adjacent the porous liners 32, the cylinder intake ports are provided with collector means that may include peripheral grooves 33 machined into the port wall and open to the exterior of the porous port liners. The peripheral grooves 33 are connected at their bottom edges with downwardly directed drilled passages 34. These in turn connect with drain means including, in the walls of each cylinder liner, a covered annular groove 36 that connects with a drain passage 38, extending downwardly in the liner wall to a point within the engine crankcase. In this way, means are provided for the return of lubricating oil collected at each cylinder by the porous inserts through the passages 34, 36 groove and passage 38 to the engine crankcase for storage and reuse. The flow of oil through this return passage network is aided by a limited flow of air from the slightly pressurized engine air chamber 21. This flow will naturally pass through the pores of the porous inserts, into the collector grooves 33 and passages 34 for each port and the drain groove 36 and passage 38 for each cylinder, thereby keeping open the pores and the passage network.

Figure 4:
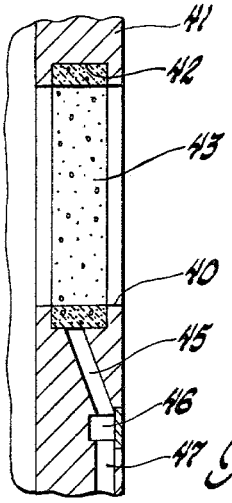
FIG. 4 is a cross-sectional view similar to FIG. 3, but showing the construction of an alternative embodiment of port liner insert and oil return system.

In FIG. 4 of the drawing, an alternative arrangement for installation of a porous liner insert is illustrated. In this arrangement, each port 40 of an engine cylinder liner 41 is provided with a peripheral recess 42 intermediate its ends in which a porous port liner insert 43 is disposed. The bottom of the recess 42 is connected with the drain network including a passage 45 from each recess leading to a peripheral covered groove 46 that connects with a drain passage 47 connected with the engine crankcase. This arrangement moves the porous inserts 43 slightly away from the edge of the port, where it is protected from the action of the piston and piston rings sliding along the liner surface.

It should now be apparent that during engine operation oil that is carried upwardly and deposited in the intake ports by motion of the piston and piston rings is received in the porous inserts and carried into the drain passage network by gravity, assisted by a slight flow of air. Thus, the oil is returned to the engine crankcase and the loss of lubricating oil into the engine combustion chambers and exhaust system is reduced.

While the invention has been described as applied to a two-stroke cycle blower-charged diesel engine, the invention is equally applicable to other engine arrangements which utilize cylinder air intake ports. It is therefore contemplated that the invention would be applicable to diesel and spark-ignition engines whether charged by an auxiliary blower, crankcase compression, or some other means. Accordingly, it is intended that the invention not be limited to the specific embodiments disclosed, but that it have the full scope permitted by the language of the following claim.

The embodiments of the invention for which an exclusive property or privilege is claimed are defined as follows:

1. The combination of an engine having oil lubricated cylinders and pistons controlling inlet ports in the cylinders, a crankcase below the cylinders to which used lubricating oil is returned for storage and reuse, and the improvement comprising porous liners in said cylinder inlet ports to receive lubricating oil delivered to the ports such as by movement of the pistons within their respective cylinders, collector means in the port walls adjacent the porous liners to receive oil draining therefrom, and return passage defining means connecting the collector means with the engine crankcase to return to the crankcase oil received in the collector means from the port liners, whereby the loss of lubricating oil through movement from the inlet ports into the engine combustion chambers and exhaust system is limited.

* * * * *